United States Patent [19]

Stieber

[11] Patent Number: 4,845,371

[45] Date of Patent: Jul. 4, 1989

[54] APPARATUS FOR GENERATING AND TRANSPORTING A CHARGED PARTICLE BEAM

[75] Inventor: Volker Stieber, Walnut Creek, Calif.

[73] Assignee: Siemens Medical Laboratories, Inc., Walnut Creek, Calif.

[21] Appl. No.: 174,575

[22] Filed: Mar. 29, 1988

[51] Int. Cl.[4] ..... H01J 3/14

[52] U.S. Cl. ..... 250/505.1; 250/396 R; 250/492.3; 378/137

[58] Field of Search ..... 250/396 R, 396 ML, 492.3, 250/505.1; 378/65, 137, 138, 12

[56] References Cited

U.S. PATENT DOCUMENTS

| | | | |
|---|---|---|---|
| 3,227,880 | 1/1966 | Wideröe | 250/505.1 |
| 4,270,053 | 5/1981 | Froitzheim | 250/505.1 |
| 4,715,056 | 12/1987 | Vlasbloem et al. | 378/146 |

*Primary Examiner*—Bruce C. Anderson
*Attorney, Agent, or Firm*—Lawrence C. Edelman

[57] ABSTRACT

An apparatus for generating and transporting a charged particle beam. The apparatus has a source which generates the charged particle beam at two current levels, and a magnet system for bending the beam. Particles of different energies are bent along different paths, whereby at a specific height within the magnet system the radial displacement from the beam axis is a monotone function of the difference between the energy and the nominal energy. At this height there is provided an energy selection filter having at least one bimetallic element. This element projects into the beam and, thus, intercepts beam particles; it is designed such that its interception distance decreases with increasing beam current. As a result, the energy range of particles passing the filter is broader at the higher current level broader than at the lower current level.

13 Claims, 2 Drawing Sheets

APPARATUS FOR GENERATING AND TRANSPORTING A CHARGED PARTICLE BEAM

BACKGROUND OF THE INVENTION

The invention relates to an apparatus for generating and transporting a charged particle beam. It relates, in particular, to an apparatus for generating and transporting the beam of an electron linear accelerator (LINAC) used in radiotherapy.

A typical LINAC uses a magnet system to deflect (by 270°) an electron beam toward an isocenter. The deflected beam is then transformed and shaped into a treatment beam having desired dimensional and energy characteristics.

On entering the magnet system, the beam contains electrons having a range of energies and trajectories. Optimally, these electrons should be deflected so that they exit the magnet system in a tight parallel beam which is centered around a central axis. To this end, a number of multi-magnet systems with highly sophisticated field configurations have been developed. These systems work, as disclosed for instance in U.S. Pat. No. 3,867,635, with energy selection filters. Such a filter is normally located in the plane of symmetry of the magnet system, because it is at that location where the radial dispersion of the various electron trajectories is most pronounced and is a monotone function of the energy dispersion. The filter contains a pair of beam shaping vanes, each radially displaced from the central electron orbit by predetermined amounts. By cutting off radial edges of the beam, the vanes limit the width of the energy band of the transmitted beam electrons to perhaps ±5% on either side of a preset energy value $E_0$.

This value results from a tradeoff: the narrower the energy band, the better the quality of the beam exiting the magnet system, but the higher the beam current necessary for generating a treatment beam of a given intensity. Additionally, the optimum band width depends also upon whether the treatment beam consists of electrons or gamma radiation, i.e. whether the LINAC operates in an "e mode" or a "y mode". In the e mode, the original electron beam, which is scattered in a foil after bending, should be as monoenergetic as possible, and should ideally have an energy width of less than $E_0 \pm 2\%$. In the y mode however, the electrons of the original beam may be energetically spread. This is because the x-rays produced by the electron beam in a target have an extremely broad energy spectrum which is fairly independent of the electron energies. Consequently, a y mode electron beam may have an energy width of at least $E_0 \pm 10\%$, and such a wide energy band is not only acceptable but even attractive: because of the heavy losses in the target, the electron beam must have a beam current which is perhaps 100 times the beam current in the e mode. This means that in the y mode power supply and shielding problems play a major role and could be reduced if less electrons were filtered out of the beam.

Accordingly, the energy selection filter disclosed in U.S. Pat. 3,867,635 requires (a) a high power electron source, (b) bulky shielding blocks and (c) extensive means for improving the treatment beam characteristics in the e mode.

It is therefore an object of this invention to provide an apparatus for generating and transporting a charged particle beam with an adjustable energy selection filter.

It is a more specific object of the invention to provide an apparatus for generating and transporting a charged particle beam with an energy selection filter which transmits beam particles having energies within a defined energy range that becomes broader with increasing current strength of the incident beam.

It is another object of the invention to provide an apparatus for generating and transporting a charged particle beam with a self-adjusting energy selection filter.

It is yet another object of this invention to provide an apparatus for generating and transporting a charged particle beam with a simple, robust and easily attachable energy selection filter.

It is still another object of this invention to improve on the existing systems for generating and transporting charged particle beams.

SUMMARY OF THE INVENTION

The invention is directed to an apparatus for generating and transporting a charged particle beam. The apparatus contains a source for generating a charged particle beam at least two different current levels; at each level the charged particles are energetically distributed around a nominal energy. The apparatus also contains a magnet system for transporting the charged particle beam within a passageway along a beam axis. Particles of different energies are transported along different trajectories which are, at least in a specific filter plane across the beam path, laterally dispersed along a spreading axis such that the lateral displacement from the beam axis is a monotone function of the difference between the particle energy and the nominal energy. The magnet system includes an energy selection filter arranged within the passageway and provided with at least one bimetallic element. This element is placed in the filter plane; it projects along the spreading axis by a predetermined interception length into the beam. Upon being exposed to the beam electrons, the bimetallic element heats up and is deformed, thereby changing its interception length and thus the energy range of the transmitted electrons. The element is designed such that its interception length decreases with increasing beam current so that at the higher current level the energy range of the filtered electron beam is broader than at the lower current level.

The bimetallic element can be of extremely simple design; in particular, it does not require parts penetrating the vacuum-tight wall of the passageway.

According to a more specific aspect of the invention, the energy selection filter contains two bimetallic elements projecting into the beam from opposite sides along the same spreading axis. Preferably, these elements are formed as tongues.

According to another aspect of the invention, the electron selection filter contains at least two bimetallic elements arranged one behind the other along the beam path. At both current levels the downstream element has a longer interception length than the upstream element. This means that the upstream element defines a broad energy band which is further narrowed down by the consecutive element. This way, the heat developed within the filter during its exposure to the beam is shared among two bimetallic elements so that thermal stresses are considerably reduced.

According to still another aspect of the invention, the bimetallic element of the energy selection filter is located downstream of a metallic plate which also projects into the beam. The arrangement is such that at the high current level, the bimetallic element is almost completely covered by the upstream plate so that at this current level the energy band is essentially defined by the plate. At the lower current level, the bimetallic element projects deeper into the beam than the plate so that in this case the energy window is further narrowed down to its proper band width.

According to a further aspect of the invention, the energy selection filter has a bellows which is, at least in its beam intercepting part, bimetallic. This bellows is incorporated into the wall of the passageway and surrounded by a cooling liquid. Such a construction affords a very effective heat removal from the filter without impairing the vacuum-tightness of the passageway.

The foregoing and other objects, features and advantages of the invention will be apparent from the following more particular description of preferred embodiments of the invention as illustrated in the accompanying drawings.

BRIEF DESCRIPTION OF THE DRAWINGS

Throughout the drawings, corresponding elements are referred to by like numerals.

DESCRIPTION OF PREFERRED EMBODIMENTS

Figure 1:
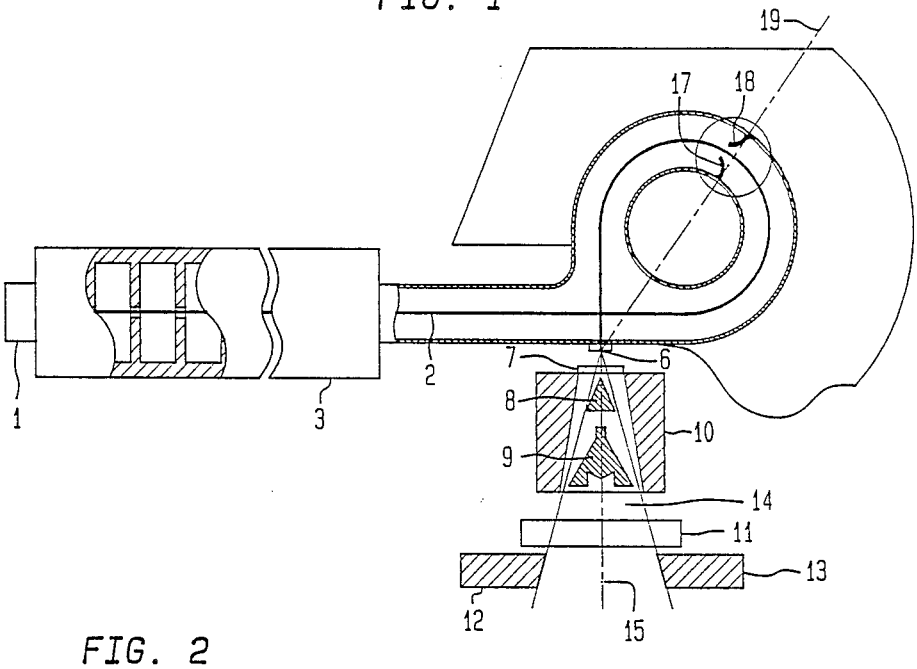
FIG. 1 is a simplified cross-section of parts of a LINAC including an apparatus according to the invention; the LINAC is shown in its y mode.

FIG. 1 schematically shows a LINAC which can operate either in the e mode or the y mode to supply an electron or x-ray treatment beam, respectively. This LINAC contains an electron gun 1 which produces an electron beam centered around a beam axis 2. The electron beam is accelerated in a waveguide 3 and then directed through an evacuated passageway 4. Passageway 4 is part of a magnet system 5 which deflects the beam 2 by 270° toward an isocenter. The deflected beam passes through a vacuum window 6 and strikes a target 7, thereby producing x-rays. The remaining electrons are absorbed in a stopper 8, and a flattening filter 9 distributes the intensity of the x-ray beam evenly over the beam cross-section. A collimator 10 and two pairs of opposed jaws 11, 12 and 13 define a beam cone with a boundary 14 and a central axis 15.

Figure 3:
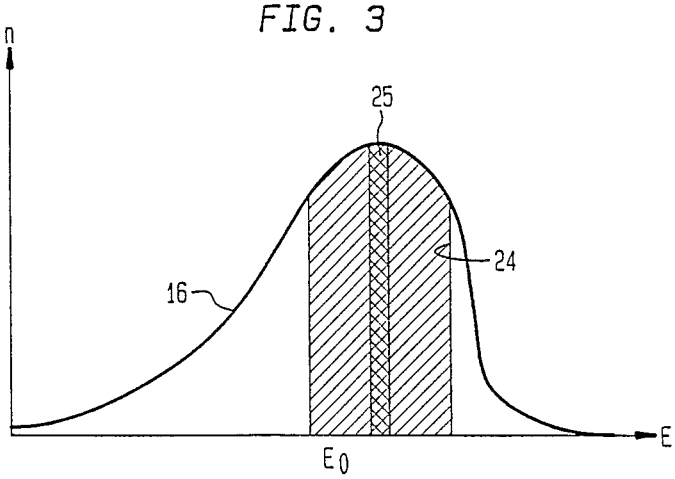
FIG. 3 is a diagram showing the number of beam electrons versus their energy.

The electrons in the beam have energies which are spread over a relatively wide range. A typical energy distribution (curve 16) is shown in FIG. 3 in which the number n of beam electrons is plotted against their energy E. Curve 16 has a maximum at a preset energy value $E_0$, a long low energy tail and a relatively sharp drop at its high energy end. This energy spectrum is well correlated with the spatial distribution of the various electrons when the beam reaches the symmetry plane of the magnet system 4. In this plane, in which the beam is bend by 135°, the dispersion of the electron trajectories in the radial direction is proportional to the dispersion of the electron momentum and is thus a monotone function of the energy dispersion.

Figure 2:
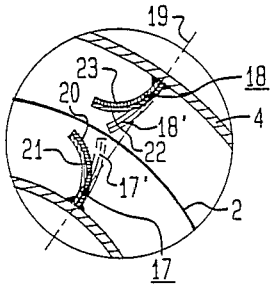
FIG. 2 shows from FIG. 1 the energy selection filter in more detail.

To filter out electrons having excessive or insufficient energies, an energy selection filter formed by two opposite bimetallic tongues 17, 18 is inserted into the passageway 4. The tongues 17, 18 are placed essentially in the plane of symmetry and project into the beam along a direction 19 ("spreading axis") which extends within the beam bending plane perpendicular to the beam axis 2. Each tongue 17, 18 consists, as can be seen in FIG. 2, of two metallic strips 20, 21 and 22, 23, respectively, both strips being rigidly connected with each other as well as the inner wall of passageway 4. Strips 20 and 22 have thermal coefficients of expansion which are higher than those of strips 21 and 23, respectively, so that tongues 17, 18 bend away from the beam axis 2 when heated, i.e. when intercepting the electron beam. Because the tongues 17, 18 are heated in proportion to the beam current, the higher the beam current, the broader the gap between the opposite tongues and thus, the wider the energy band of the beam electrons passing through the filter.

The LINAC shown in FIG. 1 operates in the y mode. In this mode, a pulsed electron beam with a duty cycle of 1:1,000 is generated. The pulses have a peak current on the order of $10^2$ mA and are 3 msec long; their preset energy $E_0$ is 6 MeV. The gap between the tongues 17, 18 is about 20 mm, resulting in an energy band of about $E_0 \pm 10\%$, i.e. about 80% of all incoming electrons are let through. This band is shown in FIG. 3 as a shaded window 24.

When the LINAC is operated in the e mode, the target, stopper and flattening filter are replaced by a set of scattering foils, and the peak current of the electron beam is reduced to about 2 mA. In this case, the tongues 17, 18 are at lower temperatures and are therefore straighter as shown in FIG. 2 by broken lines 17', 18'. Consequently, the energy band of transmitted electrons is smaller. The tongues 17, 18 are so made that they leave a gap of about 5 mm, i.e. define an energy window $E_0 \pm 1.5\%$ (shaded area 25 in FIG. 3); here only about 40% of the incoming electrons pass the filter.

Figure 4:
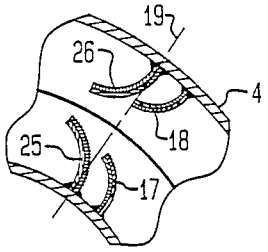
FIGS. 4, 5 and 6 show further embodiments of the energy selection filter.

To reduce thermal stresses in the electron intercepting tongues, the filter may, as shown in FIG. 4, alternatively be formed by two consecutive pairs of opposite tongues 17, 18 and 25, 26, respectively. The downstream tongues 25, 26 project further into the beam so that two consecutive tongues (i.e. tongues 17 and 25) share the filtering out of low and high energy electrons.

Figure 5:
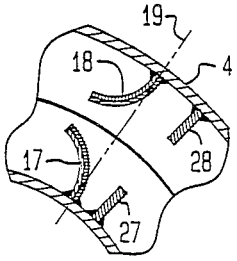

FIG. 5 depicts an alternate embodiment for handling thermal stresses. Here, a conventional slit comprised of two plates 27, 28 is placed upstream of tongues 17, 18, respectively. The plates 27, 28 are displaced from the beam axis 2 to such an extent that they block all electrons except those within an energy band of about $E_0 \pm 12\%$. The bimetallic tongues further narrow down this energy window to $E_0 \pm 10\%$ in the y mode and to $E_0 \pm 1.5\%$ in the e mode. In this embodiment, the tongues 17, 18 are less exposed to the higher energy electrons, particularly at the more critical high current level.

Figure 6:
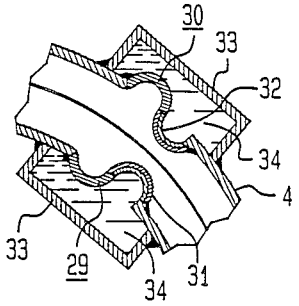

The embodiment of FIG. 6 illustrates how bimetallic elements of suitable shapes can be integrated into the wall of the passageway 4. In this embodiment the filter has two bellows-shaped elements 29. 30 which are bimetallic, at least in their beam-exposed parts 31, 32. The remaining bellows parts serve to buffer thermal deformations of parts 31, 32 so that the vacuum-tight connections between the bellows and the remaining passageway are not endangered. To remove the heat from the bellows, a chamber 33 filled with a cooling liquid 34 surrounds the filter.

The materials and dimensions of the bimetallic elements should be chosen according to the specific requirements of a given beam generating and transport system. A number of suitable of high-temperature bimetals are available; some examples are disclosed in laid-open German patent application No. 25 28 457. And it is well known how bimetals of specific compositions and forms react when exposed to electric current; for details see, for instance, the company brochure "Thermobimetall Vacoflex" issued 1970 by Vacuumschmelze GmbH, Hanau, West Germany, in particular sections IV and XI.

Having thus described the invention with particular reference to preferred forms thereof, it will be obvious to those skilled in the art to which the invention pertains, after understanding the invention, that various changes and modifications may be made therein without departing from the spirit and scope of the invention as defined by the claims appended hereto. So, there could be applied more than two current levels and/or more than one nominal energy value. Further, it is not mandatory to place the energy selection filter in the symmetry plane of a magnet system; in other planes, the energy cut-off might not be that precise, but one could obtain changes in the energy band by smaller deformations in the bimetallic elements. In addition, the filter could be inserted in magnets other than 270° bending systems, for instance 90° bending magnets or systems not deflecting at all.

I claim:

1. An apparatus for generating and transporting a beam of charged particles, comprising:

(a) a beam source for generating said beam of charged particles at two different current levels, said charged particles being energetically dispersed around a preset energy value;

(b) a magnet system for transporting said beam of charged particles through a passageway, said charged particles being spatially dispersed around a beam axis such that along a selected direction in a specific plane across the beam axis the spatial dispersion of said charged particles is at least approximately a monotone function of their energy dispersion; and (c) an energy selection filter disposed in said specific plane within the passageway, said filter including a first bimetallic element projecting along said selected direction into the beam by a given interception distance which defines the energy range of the charged particles passing the electron selection filter, said bimetallic element being adapted such that at the lower of the two different current levels the interception distance is longer and thereby said energy range smaller than at the higher of the two current levels.

2. An apparatus according to claim 1, wherein the energy selection filter includes a second bimetallic element, the first and second bimetallic elements forming a first pair of bimetallic elements projecting from opposite sides into the beam.

3. An apparatus according to claim 1, wherein the bimetallic element is formed as a tongue.

4. An apparatus according to claim 1, wherein the bimetallic element is formed as a bellows and part of the passageway.

5. An apparatus according to claim 1, wherein a third bimetallic element is disposed downstream of the first bimetallic element, said third bimetallic element projecting from the same side into the beam by a given intercepting distance which is longer than the intercepting distance of the first bimetallic element.

6. An apparatus according to claim 5, including third and fourth bimetallic elements which form a second pair of bimetallic elements projecting from opposite sides into the beam, each bimetallic element of the second pair being disposed downstream behind one of the bimetallic elements of the first pair and projecting into the beam by a given intercepting distance which is longer than the intercepting distance of the bimetallic element upstream in front of it.

7. An apparatus according to claim 1, including a metallic plate disposed upstream of the first bimetallic element and projecting from the same side into a beam by a given intercepting distance which is shorter than the intercepting distance of the first bimetallic element.

8. An apparatus according to claim 2, including first and second metallic plates disposed upstream in front of the first and second bimetallic elements, respectively, each metallic plate projecting into the beam by a given intercepting distance which is shorter than the intercepting distance of the bimetallic element downstream behind it.

9. An apparatus according to claim 1, wherein the bimetallic element is cooled by a cooling liquid.

10. An apparatus according to claim 1, wherein the energy range of the beam particles passing the energy selection filter is at the lower current level by at least a factor 5 smaller than at the higher current level.

11. An apparatus according to claim 10, wherein said energy range has a width of up to $E_0 \pm 2\%$, $E_0$ being the preset energy value, at the lower current level.

12. An apparatus according to claim 1, wherein the beam of charged particles is a pulsed electron beam, the magnetic system bends said beam by 270° in a bending plane, the current at the higher and lower of said two different current levels ranges between 50 and 150 mA and 0.5 and 3 mA, respectively, the preset energy value ranges between 5 and 20 MeV, and the the pulsed electron beam has a duty cycle between 1:500 and 1:2,000.

13. An apparatus for generating and transporting an electron beam, comprising:

(a) a beam source for generating said electron beam at two different current levels;

(b) a magnet system for bending said electron beam by 270° in a bending plane, said magnet system having a plane of symmetry being perpendicular to the bending plane; and (c) an energy selection filter disposed in said plane of symmetry, said filter including a bimetallic element projecting into the electron beam by a given interception distance, said bimetallic element being adapted such that at the lower of the two different current levels the interception distance is longer than at the higher of the two current levels.

* * * * *